US006199732B1

(12) United States Patent
Swetish

(10) Patent No.: US 6,199,732 B1
(45) Date of Patent: Mar. 13, 2001

(54) LOAD SUPPORT SYSTEM

(75) Inventor: Thomas R. Swetish, Racine, WI (US)

(73) Assignee: Johnson Outdoors Inc., Sturtevant, WI (US)

( * ) Notice: Subject to any disclaimer, the term of this patent is extended or adjusted under 35 U.S.C. 154(b) by 0 days.

(21) Appl. No.: 09/307,233

(22) Filed: May 7, 1999

(51) Int. Cl.[7] ..... A45F 3/08
(52) U.S. Cl. ..... 224/262; 224/637; 224/641
(58) Field of Search ..... 224/259, 261, 224/262, 263, 627, 628, 631–637, 640, 641

(56) References Cited

U.S. PATENT DOCUMENTS

| | | | | |
|---|---|---|---|---|
| 385,429 | | 7/1888 | Sohner . | |
| 1,150,664 | | 8/1915 | Cramer . | |
| 1,448,918 | * | 3/1923 | Drager | 224/261 |
| 1,879,480 | | 9/1932 | Pures . | |
| 2,675,150 | * | 4/1954 | Ackerman | 224/641 X |
| 2,760,699 | | 8/1956 | Rivers-McPherson . | |

(List continued on next page.)

FOREIGN PATENT DOCUMENTS

| | | | | |
|---|---|---|---|---|
| 597307 | | 5/1990 | (AU) . | |
| 42351/89 | | 7/1990 | (AU) . | |
| 1044197 | | 12/1978 | (CA) . | |
| 1124693 | | 6/1982 | (CA) . | |
| 802469 | * | 2/1951 | (DE) | 224/210 |
| 27 54 061 | | 6/1979 | (DE) . | |
| 39 18 346 | | 12/1990 | (DE) . | |
| 92 11 361 | | 1/1993 | (DE) . | |
| 273 087 | | 12/1986 | (EP) . | |
| 0 692 206A1 | | 6/1995 | (EP) . | |
| 335811 | | 3/1959 | (FR) . | |
| 2 586 539 | | 9/1985 | (FR) . | |
| 2 630 897 | | 11/1989 | (FR) . | |
| 2660173 | | 3/1990 | (FR) . | |
| 2677235 | | 12/1992 | (FR) . | |
| 431119 | * | 7/1935 | (GB) | 224/210 |
| 661235 | * | 11/1951 | (GB) | 224/211 |
| 764880 | * | 1/1957 | (GB) | 224/210 |
| 223 930 | | 4/1990 | (GB) . | |
| 61404 | * | 6/1940 | (NO) | 224/210 |
| 68057 | * | 11/1951 | (NO) | 224/212 |
| 82261 | * | 8/1953 | (NO) | 224/261 |
| 151784 | * | 10/1955 | (SU) | 224/210 |
| WO 92/21265 | | 12/1992 | (WO) . | |
| WO 97/49312 | | 12/1997 | (WO) . | |

*Primary Examiner*—Gregory M. Vidovich
(74) *Attorney, Agent, or Firm*—Foley & Lardner

(57) ABSTRACT

A load support system for carrying a load on a user's back includes a load support, first and second user engaging surfaces, and first and second arms extending between the load support and the first and second user-engaging surfaces, respectively. The load support includes a back panel configured to extend substantially parallel to the user's mid-coronal plane when worn. The first and second user-engaging surfaces are configured to engage the user on opposite sides of the user's mid-sagital plane when worn. The first and second arms are coupled to the back panel at first and second spaced locations along a first axis on opposite sides of the user's mid-sagital plane. The first arm has a first end pivotably coupled to the back panel about a second axis oblique to the first axis and oblique to a transverse plane of the user. The first arm further includes a second end coupled to the first user-engaging surface. The second arm has a third end pivotably coupled to the back panel about a third axis oblique to the first axis and oblique to the transverse plane of the user. The second arm further includes a fourth end coupled to the second user-engaging surface. In one exemplary embodiment, the load support system includes a body coupled to the back panel, wherein the first and third ends of the first and third arms are pivotably coupled to the body.

35 Claims, 6 Drawing Sheets

U.S. PATENT DOCUMENTS

| | | |
|---|---|---|
| 2,925,205 | 2/1960 | Hunt . |
| 3,180,545 | 4/1965 | Southwick . |
| 3,355,075 | 11/1967 | Dean . |
| 3,442,427 | 5/1969 | Arnell et al. . |
| 3,563,431 | 2/1971 | Pletz . |
| 3,653,566 | 4/1972 | Owens . |
| 3,827,612 | 8/1974 | Mead et al. . |
| 3,831,827 | 8/1974 | Olson . |
| 3,840,162 | 10/1974 | Horenstein . |
| 3,856,191 | 12/1974 | Pohl . |
| 3,889,859 | 6/1975 | Joseph . |
| 3,899,109 | 8/1975 | Noice . |
| 3,938,718 | 2/1976 | Madison . |
| 4,015,759 | 4/1977 | Dreissigacker et al. . |
| 4,049,164 | 9/1977 | Sullivan et al. . |
| 4,099,657 | 7/1978 | Zufich . |
| 4,114,788 | 9/1978 | Zufich . |
| 4,135,654 | 1/1979 | Chu . |
| 4,194,656 | 3/1980 | Zufich . |
| 4,214,685 | 7/1980 | Pletz . |
| 4,217,998 | 8/1980 | Alexander . |
| 4,298,149 | 11/1981 | Gottschalk et al. . |
| 4,303,186 | 12/1981 | Ollinger . |
| 4,307,826 | 12/1981 | Stewart . |
| 4,318,502 | 3/1982 | Lowe et al. . |
| 4,361,259 | 11/1982 | Chanter . |
| 4,369,903 | 1/1983 | Wilkes . |
| 4,420,103 | 12/1983 | Douglass . |
| 4,438,763 | 3/1984 | Zablen . |
| 4,558,808 | 12/1985 | Fullmer . |
| 4,676,418 | 6/1987 | Lowe . |
| 4,715,293 | 12/1987 | Cobbs . |
| 4,750,654 | 6/1988 | Menetrier . |
| 4,830,245 | 5/1989 | Arakaki . |
| 4,842,173 | 6/1989 | Scherer . |
| 4,884,731 | 12/1989 | Sibley . |
| 4,911,346 | 3/1990 | Shallman . |
| 5,004,135 | 4/1991 | DuFournet et al. . |
| 5,038,984 | 8/1991 | Izzo . |
| 5,114,059 | 5/1992 | Thatcher . |
| 5,181,638 | 1/1993 | McHale . |
| 5,184,764 | 2/1993 | Orovan et al. . |
| 5,240,159 | 8/1993 | Gregory . |
| 5,284,279 | 2/1994 | Sason et al. . |
| 5,361,955 | 11/1994 | Gregory . |
| 5,366,126 | 11/1994 | Dausien . |
| 5,464,136 | 11/1995 | Eddy . |
| 5,503,314 | 4/1996 | Fiscus . |
| 5,553,759 | 9/1996 | McMaster et al. . |
| 5,836,489 * | 11/1998 | Swetish ..... 224/262 |

* cited by examiner

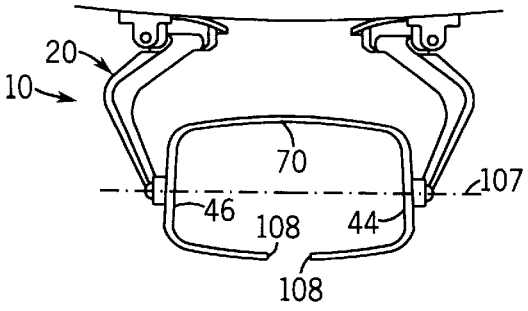
FIG. 7
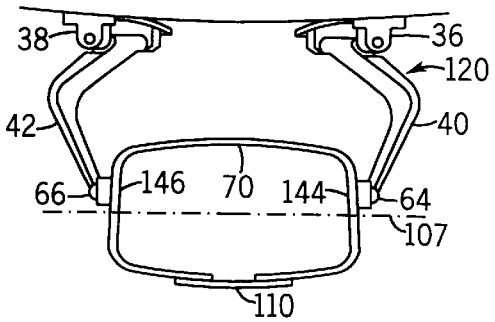
FIG. 8
FIG. 10
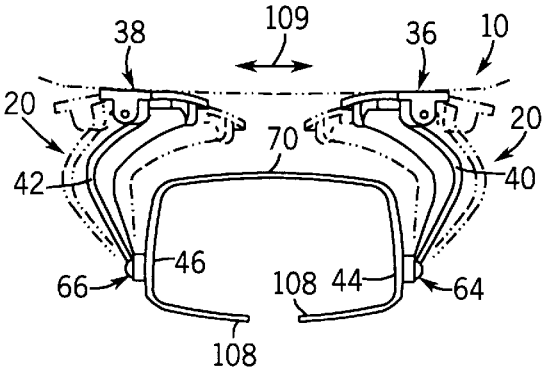
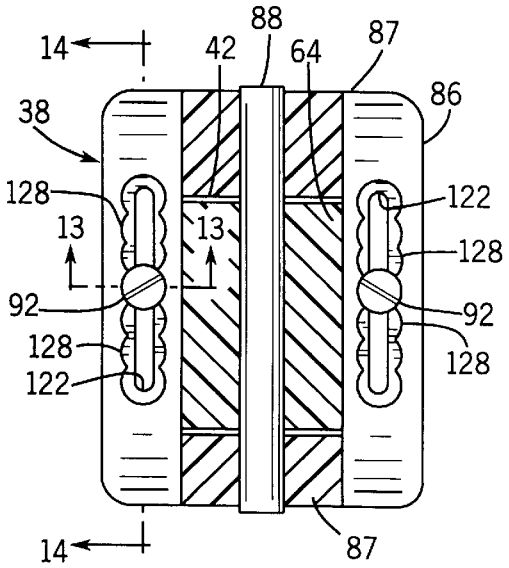
FIG. 12
FIG. 11
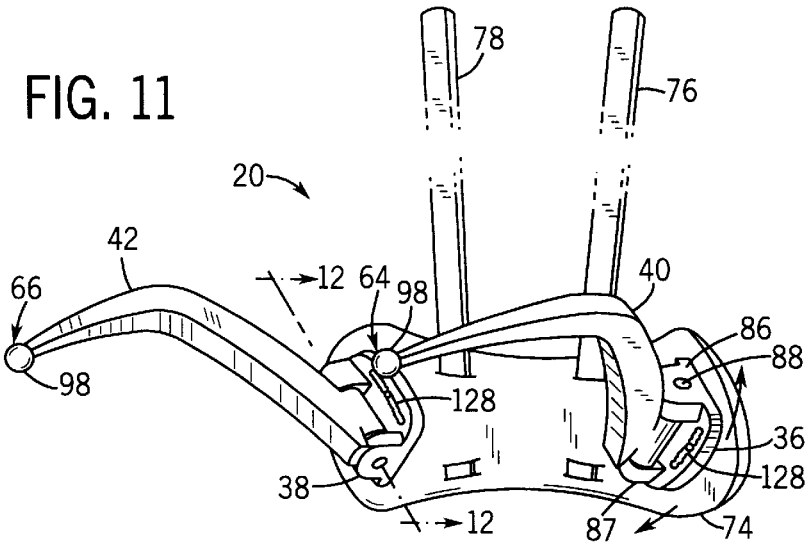

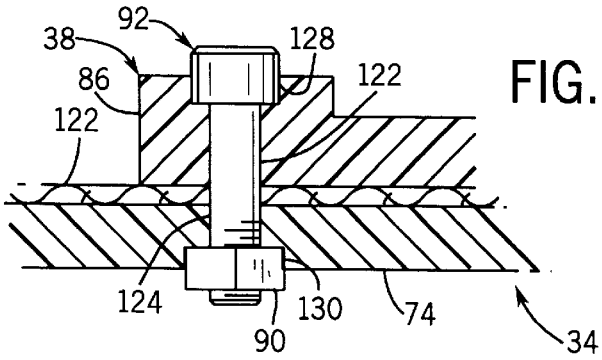
FIG. 13
FIG. 14
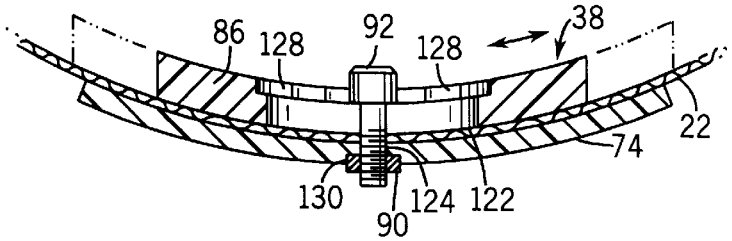
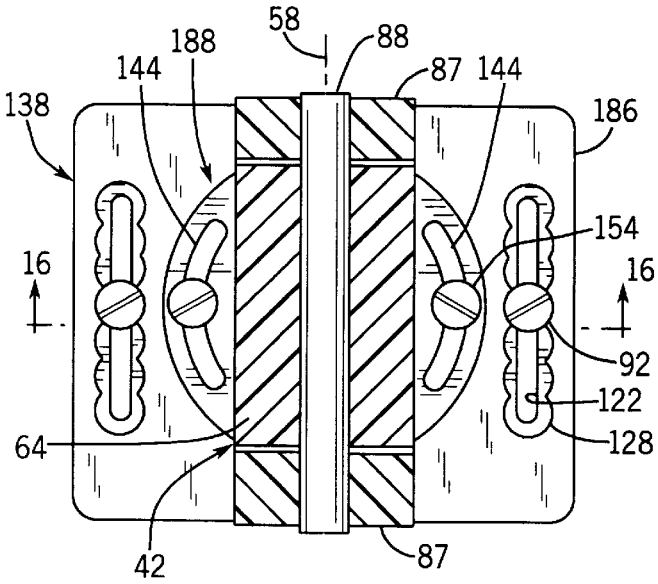
FIG. 15
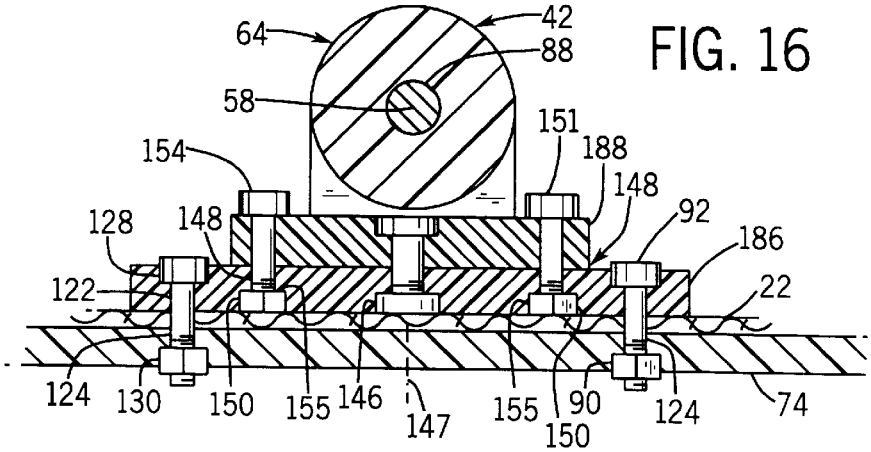
FIG. 16

LOAD SUPPORT SYSTEM

FIELD OF THE INVENTION

The present invention relates to systems for supporting various loads on a user's back. In particular, the present invention relates to a load support system and a load support mounting device that supports loads on a user's back while better accommodating the user's natural movement.

BACKGROUND OF THE INVENTION

Load support systems are commonly used by campers, scuba divers, camera operators and students to support loads such as camping equipment, diving equipment, camera equipment or various items in a receptacle on the user's back. Such load support systems typically include a load support which carries the equipment or items and which is supported adjacent the user's back. To enable the load support to be supported adjacent to the user's back, the load support includes a back panel which is connected directly or indirectly to shoulder straps. Some load support systems additionally include a waist belt connected to the back panel.

Despite the numerous different types of load support systems commonly used for supporting such various loads on the user's back, such load support systems are uncomfortable to wear. This is largely due to the failure of current load support systems to adequately accommodate the to-and-fro natural movement of the user during walking or hiking. Such systems also fail to comfortably transmit loads to the user without creating user fatigue.

Thus, there is a continuing need for a load support system that effectively transmits loads to the user without creating user fatigue and that accommodates the user's natural movement during walking or hiking.

SUMMARY OF THE INVENTION

The present invention provides a load support system for carrying a load on a user's back includes a load support, first and second user engaging surfaces, and first and second arms extending between the load support and the first and second user-engaging surfaces, respectively. The load support includes a back panel configured to extend substantially parallel to the user's mid-coronal plane when worn. The first and second user-engaging surfaces are configured to engage the user on opposite sides of the user's mid-sagital plane when worn. The first and second arms are coupled to the back panel at first and second spaced locations along a first axis on opposite sides of the user's mid-sagital plane. The first arm has a first end pivotally coupled to the back panel about a second axis oblique to the first axis and oblique to a transverse plane of the user. The first arm further includes a second end coupled to the first user-engaging surface. The second arm has a third end pivotally coupled to the body about a third axis oblique (i.e. not parallel and not perpendicular) to the first axis and oblique to the transverse plane of the user. The second arm further includes a fourth end coupled to the second user-engaging surface.

The present invention also provides a load support mounting device that includes a body adapted to be coupled to the load support, first and second user-engaging surfaces and first and second arms coupled to the body at first and second spaced locations along an axis. The first arm has a first end pivotally coupled to the body about a second axis oblique to the first axis and a second end coupled to the first user-engaging surface. The second arm has a third end pivotally coupled to the body about a third axis oblique to the first axis and a second end coupled to the second user-engaging surface.

The present invention provides a load support system for supporting a load on a user's back. The load support system includes a load support, a waist belt configured to encircle a waist of the user and first and second arms extending between the load support and the waist belt. The load support includes a back panel configured to extend substantially parallel to the user's mid-coronal plane and across opposite sides of the user's mid-sagital plane when worn by the user. The first and second arms are coupled to the back panel along a first axis and on opposite sides of the user's mid-sagital plane. The first arm has a first end pivotably coupled to the back panel about a second axis oblique to the user's mid-transverse plane and a second end pivotably coupled to the waist belt. The second arm has a third end pivotably coupled to the back panel about a third axis oblique to the user's mid-transverse plane and a fourth end coupled to the waist belt.

BRIEF DESCRIPTION OF THE DRAWINGS

FIG. 7 is a fragmentary top elevational view of the load support system of FIG. 1 illustrating arms of the load mounting device terminating forward the user's mid-coronal plane.

FIG. 8 is a fragmentary top elevational view of a second embodiment of the load support system of FIG. 1 illustrating the arms of the load mounting device terminating rearward of the user's mid-coronal plane.

FIG. 10 is a fragmentary top elevational view of the load support system of FIG. 1 illustrating adjustment of the arms of the load mounting device to accommodate users having different hip and waist widths.

FIG. 11 is a perspective view of the load mounting device of FIG. 1 illustrating adjustment of hinge members.

FIG. 12 is a sectional view of one of the hinge members of FIG. 11 taken along lines 12—12.

FIG. 13 is a sectional view of the hinge of FIG. 12 taken along lines 13—13.

FIG. 14 is a sectional view of the hinge of FIG. 11 taken along lines 14—14.

FIG. 15 is a sectional view of an alternative embodiment of the hinge of FIG. 12.

FIG. 16 is a sectional view of the hinge of FIG. 15 taken along lines 16—16.

DETAILED DESCRIPTION OF THE PREFERRED EMBODIMENTS

Figure 1:
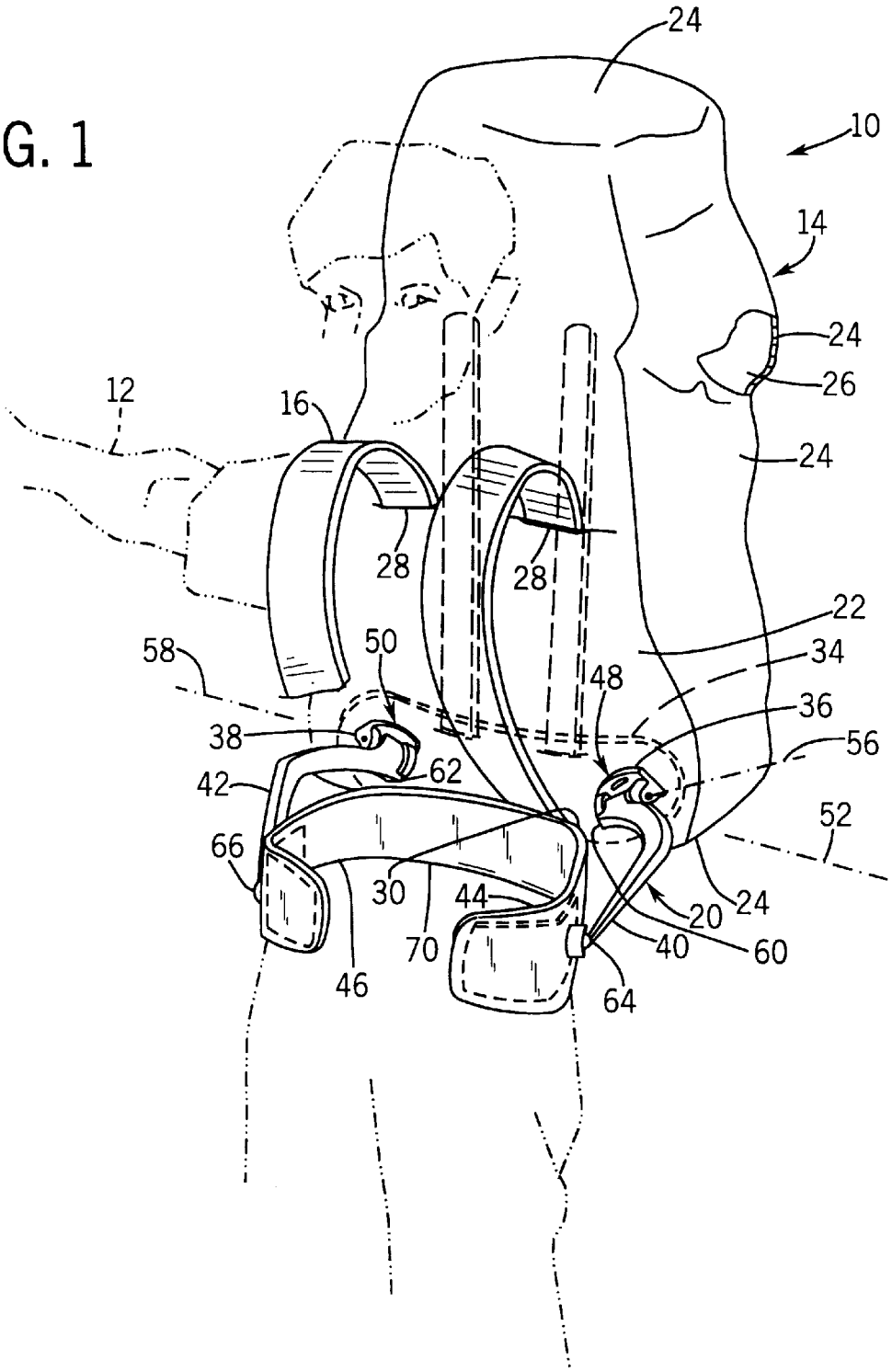
FIG. 1 is a perspective view of an exemplary load support system supported on a back of a user by shoulder supports and a load mounting device.

FIG. 1 is a perspective of a load support system 10 being worn and carried by a user 12 (shown in phantom). Load support system 10 generally includes load support 14, shoulder supports 16 and load mounting device 20. Load support 14 comprises a structure configured for containing articles or equipment or for releasably holding or retaining articles or equipment adjacent to the back of user 12. Load support 14 includes a back panel 22 configured to extend along the back of user 12 in a plane substantially parallel to the back of the user 12 (i.e., substantially parallel to the mid-coronal plane of user 12) when load support system 10 is mounted upon user 12. Back panel 22 is rigid and is coupled to mounting device 20. In the exemplary embodiment, back panel 22 is formed from a flexible material that is rigidified by mounting device 20. Alternatively, back panel 22 may itself include a sufficiently rigid frame or reinforcement stays or supports to provide a rigid base to support the load carried by load support 14 and to transmit the load to user 12 through shoulder supports 16 and mounting device 20. Moreover, back panel 22 may alternatively be formed from a substantially rigid material such as various well-known substantially inflexible polymers or metals.

In the exemplary embodiment, load support 14 additionally includes a plurality of panels 24 extending from back panel 22 to form a hollow interior 26 for containing loose articles such as clothes, camping equipment or individual items. Alternatively, load support 14 may be configured to support other loads along the back of user 12. For example, back panel 22 may alternatively be configured to be releasably mounted to distinct loads such as equipment including cameras and diving air tanks.

Shoulder supports 16 comprise two curved members extending from back panel 22 along the back of user 12 over the shoulders of user 12 to support load support 14 on the user's shoulders. Shoulder supports 16 are preferably flexible straps having ends 28 secured to an upper portion of back panel 22 and opposite ends 30 secured to a lower portion of back panel 22. Alternatively, shoulder supports 16 may comprise substantially rigid curved members extending from back panel 22 which are not connected to a lower portion of back panel 22 and which merely rest upon the shoulders of user 12.

Mounting device 20 extends from back panel 22 of load support 14 into further engagement with user 12. Mounting device 20 spaces load support 14 from user 12, stabilizes load support 14 relative to user 12 and transmits load from load support 14 to the waist and hips of user 12 to reduce the amount of load being borne by the shoulders of user 12. In addition to supporting load support 14 relative to user 12, mounting device 20 accommodates the natural movement of user 12 during walking or hiking and facilitates the removal or attachment of load support system 10.

Mounting device 20 generally includes body 34, hinge members 36, 38, arms 40, 42, and user-engaging surfaces 44, 46. Body 34 comprises a relatively rigid member configured to at least partially rigidify back panel 22 and to support hinge members 36 and 38. Body 34 is preferably coupled to back panel 22 along interior 26 with back panel 22 captured between body 34 and hinge members 36 and 38. Alternatively, body 34 may be secured to back panel 22 on the exterior of load support 14 and back panel 22. In the alternative e mbodiments where back panel 22 is itself sufficiently rigid such that back panel 22 does not twist or deform under load and such that hinge members 36 and 38 do nct shift relative to one another under load, body 34 may be omitted such that hinge members 36 and 38 are independently mounted directly to back panel 22.

Hinge members 36 and 38 are affixed to back panel 22 at spaced-apart locations 48, 50 along an axis 52 linearly extending between locations 48 and 50. Hinge members 36 and 38 are coupled to back panel 22 and body 34 on opposite sides of the mid-sagital plane of user 12 when load support system 10 is worn by user 12. Hinge members 36 and 38 pivotally support arms 40 and 42 about axes 56, 58, respectively. Axes 56 and 58 extend oblique (i.e., at an angle neither parallel nor perpendicular) to axis 52 and oblique to a transverse plane extending through the waist of user 12.

Arms 40 and 42 pivotally extend from hinge members 36 and 38 in a direction generally non-parallel to the mid-coronal plane of user 12. Arms 40 and 42 include ends 60 and 62 pivotally supported by hinge members 36 and 38 and ends 64 and 66 coupled to user-engaging surfaces 44 and 46, respectively.

User-engaging surfaces 44 and 46 engage user 12 to transmit loads from load support 14 through arms 40 and 42 to user 12. User-engaging surfaces 44 and 46 preferably comprise soft compressible surfaces abutting against the waist and hips of user 12. User-engaging surfaces 44 and 46 preferably face one another on opposite sides of the mid-sagital plane of user 12. User-engaging surfaces 44 and 46 are preferably interconnected by a band 70 extending from the opposite sides of user 12 along the posterior of user 12. Ends 64 and (66 of arms 40 and 42 are preferably coupled to user-engaging surfaces 44 and 46 directly above and in alignment with the iliac crest of the hips of user 12. As a result, loads are transmitted directly to the user's hip bones.

Figure 2:
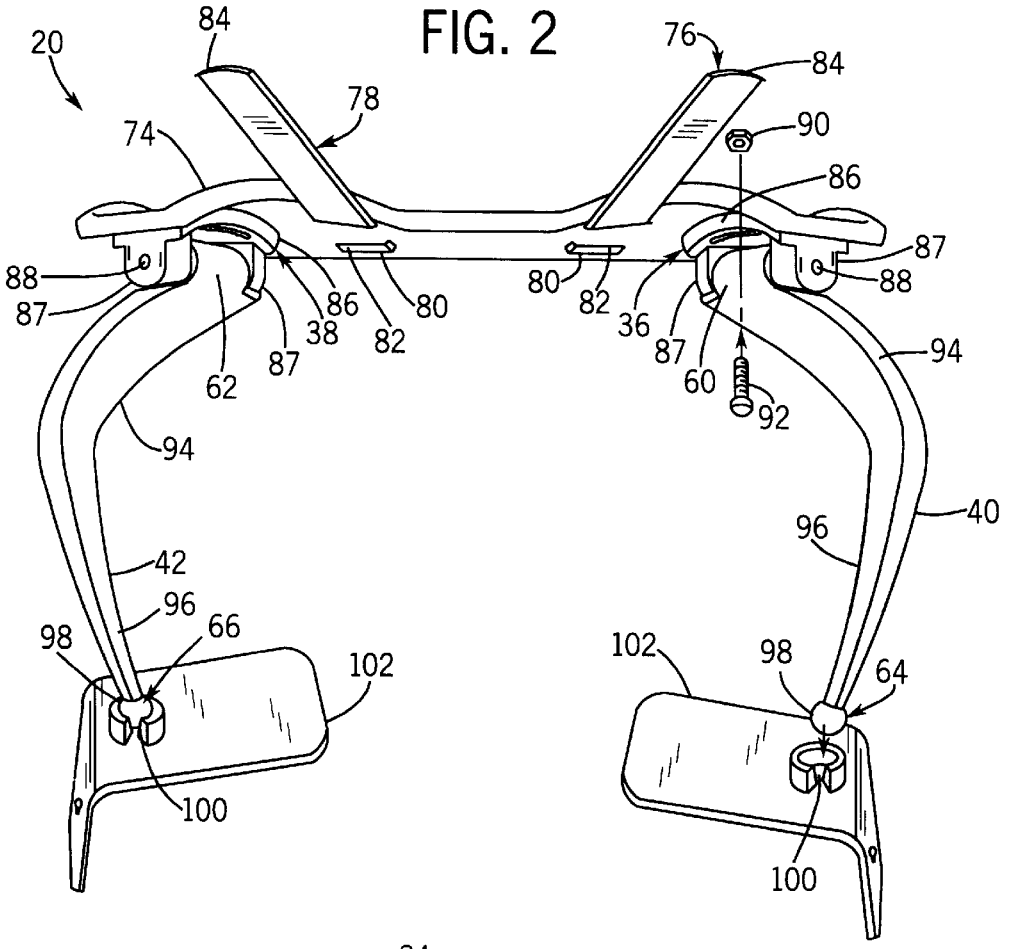
FIG. 2 is a top elevational view of the load mounting device of FIG. 1 with portions removed for purposes of illustration.
Figure 3:
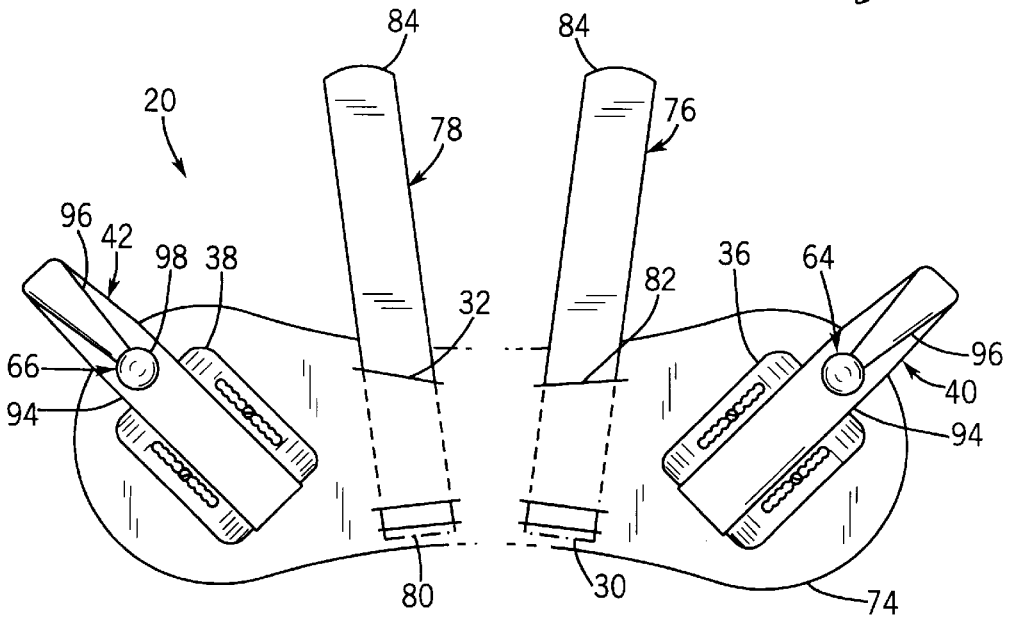
FIG. 3 is a front elevational view of the load mounting device of FIG. 1 with portions removed for purposes of illustration.

FIGS. 2 and 3 illustrate mounting system 20 in greater detail. FIG. 2 is a top elevational view of mounting system 20 while FIG. 3 is a front elevational view of mounting system 20 with portions removed to better illustrate ends 64 and 66 of arms 40 and 42, respectively. As best shown by FIGS. 2 and 3, body 34 includes base 74 and stays 76, 78. Base 74 comprises an elongate substantially flat dog-boned shaped member made from a relatively rigid material such as a high-density plastic, polyethylene or glass-filled nylon. Base 74 is preferably configured for being mounted within interior 26 of load support 14. Base 74 supports hinge members 36, 38 and prevents hinge members 36 and 38 from bowing when transmitting loads to arms 40 and 42. Base 74 further supports stays 76 and 78.

Stays 76 and 78 comprise elongate relatively rigid poles or bands having ends 80 captured within aligned slots 82 and ends 84 extending upward along back panel 22. Stays 76 and 78 are preferably formed from aluminum. Alternatively, stays 76 and 78 may be formed from a high-density plastic, polyethylene or a glass-filled nylon. Stays 76 and 78 rigidify back panel 22 (shown in FIG. 1) and further prevent base 74 from twisting during loading. Overall, base 74 and stays 76, 78 act as a rigid frame secured along back panel 22. Alternatively, base 74 and stays 76, 78 may be replaced with a single rigid unitary frame secured to or integrally formed as part of back panel 22.

As best shown by FIG. 2, hinge members 36 and 38 each preferably include a support 86, post mounts 87 and post 88. Support 86 provides a base or foundation which is secured to back panel 22 of load support 14 and base 74 of body 34. Post mounts 87 extends from support 86 to support post 88 about which ends 60 and 62 of arms 40 and 42 pivot. As will be described hereinafter with respect to FIGS. 10–13, support 86 is preferably movably coupled to back panel 22 and base 74. Although less desirable, support 86 may be permanently affixed in place to back panel 22 or base 74. As will be appreciated, ends 60 and 62 of arms 40 and 42 may be pivotally coupled to base 74 and back panel 22 by various other well-known hinge or pivot mechanisms whereby ends 60 and 62 pivot about axes 56 and 58 oblique to axis 52 (shown in FIG. 1). Hinge members 36 and 38 are secured to base 74 by fasteners such as nut 90 and bolt 92. Alternatively, hinge members 36 and 38 may be secured to base 74 and back panel 22 by various other well-known fasteners, adhesives, stitching and the like. In addition, hinge members 36 and 38 may be welded or integrally formed as part of a single unitary body with base 74, or a composite rigid frame secured to or formed as part of back panel 22.

Arms 40 and 42 are substantially rigid and capable of transmitting loads. Arms 40 and 42 are preferably formed from glass-filled nylon. Alternatively, arms 42 may be formed from a high density polyethylene or polymer. As best shown by FIG. 2, arms 40 and 42 are preferably bowed or curved so as to include diverging portions 94 extending from hinge members 36 and 38 and converging portions 96 extending from the diverging portions 94 and terminating at ends 64 and 66, respectively. Because arms 40 and 42 include diverging portions 94 and converging portions 96, arms 40 and 42 extend about the waist of user 12 from the posterior of user 12 across the mid-coronal plane and into attachment with user-engaging surfaces 44 and 46 above the user's iliac crest or to the anterior of the user's mid-coronal plane to better mount the load to the user. In addition, arms 40 and 42, space base 74 and back panel 22 from the posterior of user 12 for ventilation.

As further shown by FIGS. 2 and 3, arms 40 and 42 terminate at ends 64 and 66, where arms 40 and 42 include balls 98 configured to be received within correspondingly sized sockets 100. Sockets 100 are integrally formed as part of inserts 102 which are coupled to band 70 adjacent user-engaging surfaces 44 and 46. Inserts 102 are preferably formed from a semi-rigid polymer material such as high density polyethylene or polyurethane. Inserts 102 disperse load transmitted through arms 40 and 42 to above the user's iliac crest and along the user's waist without deformation. Sockets 100 and balls 98 of arms 40 and 42 provide universal joints about which ends 64 and 66 pivot relative to user-engaging surfaces 44 and 46 (as shown in FIG. 1).

Figure 4:
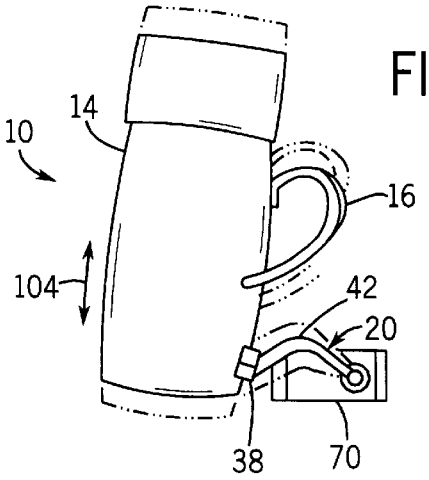
FIG. 4 is a side elevational view of the load support system of FIG. 1 illustrating loads exerted upon the load support system.
Figure 5:
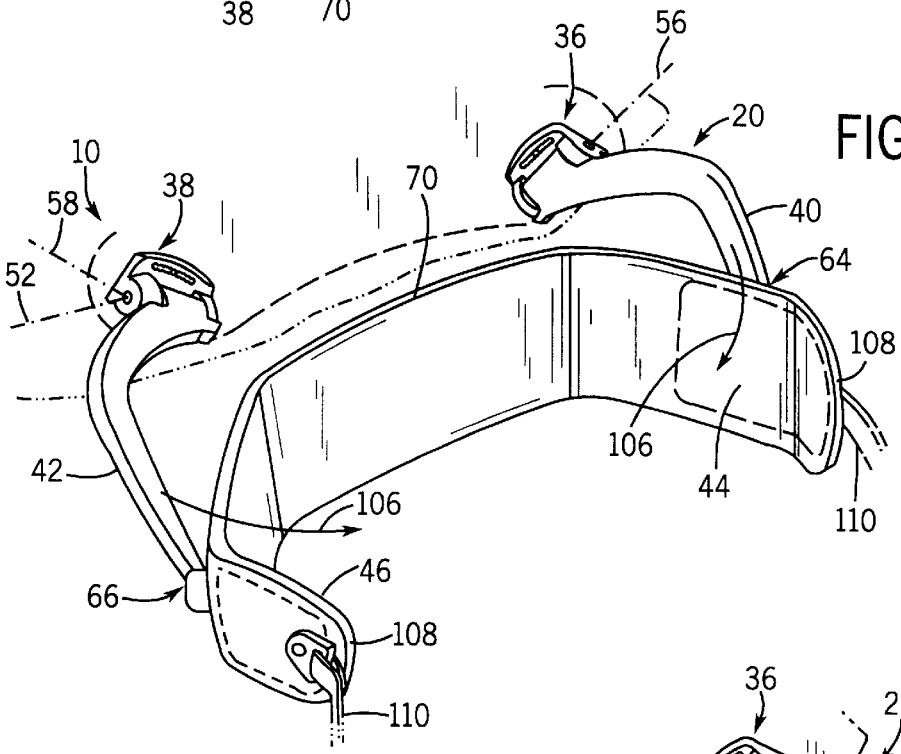
FIG. 5 is a perspective view of the load support system of FIG. 1 illustrating arms of the load mounting device pivoting towards one another under load.
Figure 6:
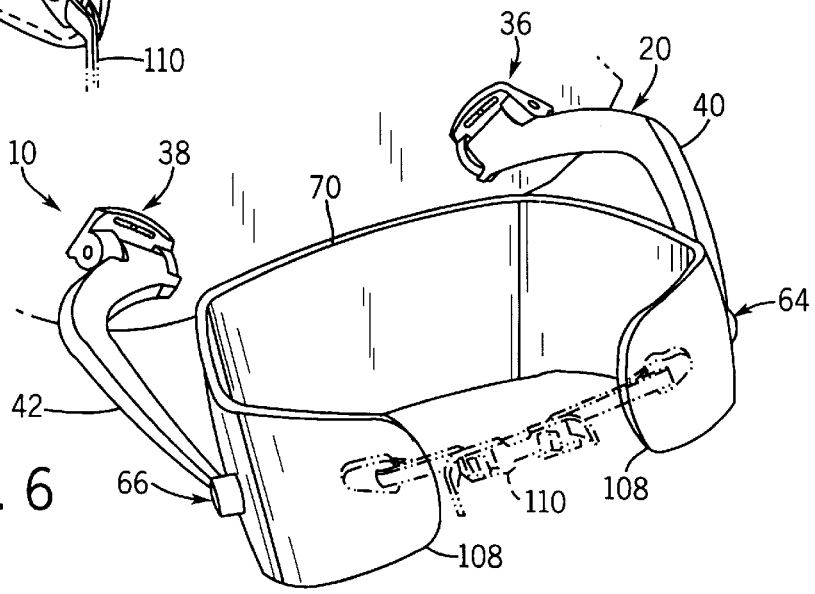
FIG. 6 is a fragmentary perspective v:iew of the load support system of FIG. 5 illustrating the ends of a waist band connected.

FIGS. 4–6 illustrate actuation of arms .40 and 42 in response to loads from load support 14. As shown by FIG. 4, in response to vertical loading as indicated by arrow 104, load support 14 moves slightly downward causing arms 40 and 42 to pivot upward and inward as indicated by arrows 106 of FIG. 5. This is due to the fact that arms 40 and 42 pivot about axes 56 and 58 oblique to the generally horizontal axis 52. In the exemplary embodiment where axes 56 and 58 extend at approximately 45 degrees relative to axis 52, every ten pounds of load carried by load support 14 results in arms 42 and 44 creating ten pounds of squeezing force inward against user 12 at user-engaging surfaces 44 and 46 (based on the principles of torque). This inward squeezing force better retains and stabilizes load support system 10 upon user 12. In the exemplary embodiment shown in FIG. 7, ends 64 and 66 are coupled to user-engaging surfaces 44 and 46 forward in the mid-coronal plane of user 12. As a result, this inward squeezing force retains mounting device 20 above the waist of user 12 without the need for buckles or other connectors interconnecting ends 108 of band 70 along the anterior of user 12. Consequently, load support system 10 may be easily mounted to the user by mounting system 20 by simply placing band 70 and user-engaging surfaces 44 and 46 against the posterior and sides of user 12. As shown by FIG. 5, an optional connecting strap 110 may be included to connect ends 108.

FIG. 8 illustrates an alternative mounting mechanism 120 in which ends 64 and 66 of arms 40 and 42 are coupled to user-engaging surfaces 44 and 46 extending posterior to the user's mid-sagital plane 107. In such an alternative configuration, connector strap 110 maintains user-engaging surfaces 44 and 46 as well as band 70 about the waist of user 12.

Figure 9A:
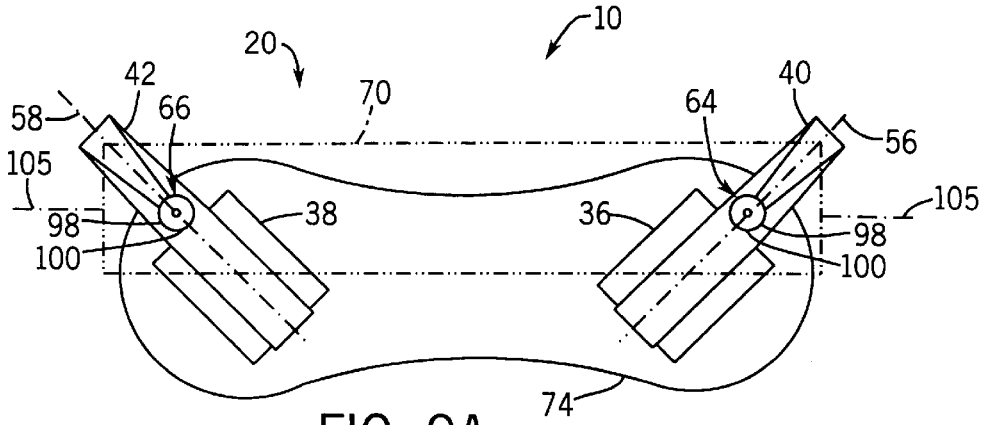
FIG. 9A is a partial schematic illustration of the load support system of FIG. 1 when the user is as rest.
Figure 9B:
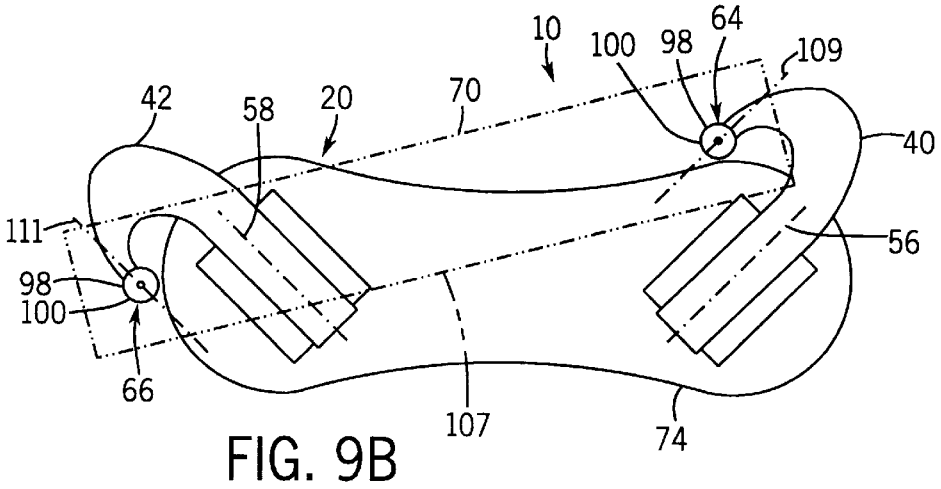
FIG. 9B is a partial schematic illustration of the load support system of FIG. 9A when the user is stepping forward with his or her right leg.
Figure 9C:
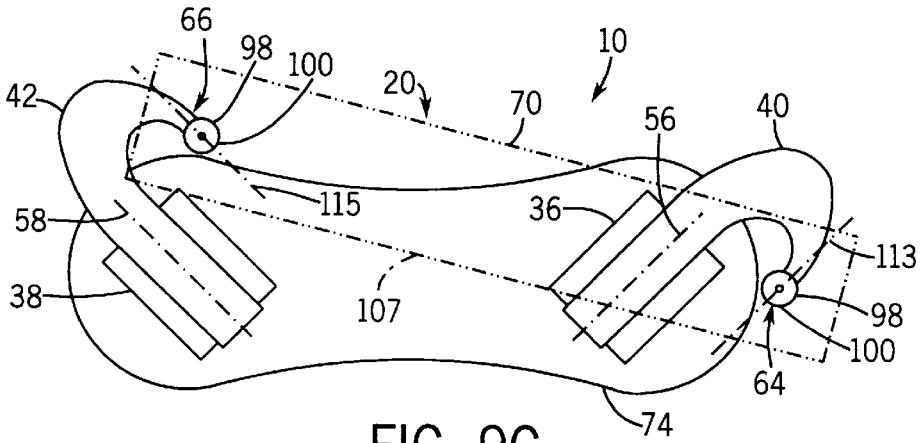
FIG. 9C is a partial schematic illustration of the load support system of FIG. 9B when the user is stepping forward with the his or her left leg.

In addition to creating an inward clamping force at ends 64 and 66 of arms 40 and 42, respectively, mounting device 20 also effectively accommodates the user's natural to-and-fro movement during walking or hiking. FIGS. 9A–9C illustrate, in an exaggerated fashion, the ability of mounting device 20 to accommodate the user's natural to and fro movement. FIG. 9A depicts mounting device 20 when the user is standing or otherwise at rest. In particular, when at rest, the user's hips or hipbones are substantially horizontal such that band 70, wrapped about the user's waist, extends generally horizontal. The weight bearing down upon base 74 is transmitted to the hips of the user via arms 40 and 42 and band 70. Because ends 64 and 66 of arms 40 and 42 are pivotally coupled to band 70 by balls 98 and sockets 100, mounting device 20 provides for a pivotable movement about axis 105.

As shown by FIGS. 9B and 9C, once a mover begins walking, the user's hips alternately rise and fall in a to-and-fro fashion. As a result, band 70 secured at least partially about the waist of the user also rises and falls. Arms 40 and 42 correspondingly pivot about axes 56 and 58, respectively, and balls 98 rotate ithin sockets 100 to accommodate the user's natural movement while maintaining ase 74 in a consistent substantially horizontal orientation. As shown by FIG. 9B, when the user steps forward with his or her right leg, arm 40 pivots upward and arm 42 pivots downward as band 70 and the hips of the user pivot or rock about axes 107 in a counterclockwise fashion. At the same time ends 64 and 66 of arms 40 and 42 pivot about axes 109 and 111, respectively. As shown by FIG. 9C, when the user steps forward with his or her left leg, arm 40 pivots downward and arm 42 pivots upward as user hips and band 70 pivot or rock about axes 107 in a clockwise fashion. At the same time, ends 64 and 66 of arms 40 and 42 pivot about axes 113 and 115, respectively. Consequently, mounting device 20 provides two degrees of freedom, about axis 105 and about axis 107, while transmitting load to the user's hip (i.e., above the user's iliac crest) on substantially opposite sides of the user's mid-sagital plane. As a result, load support system 10 is more comfortable and less fatiguing during walking or hiking.

As shown by FIG. 10, to accommodate users having different sized waists or hips, mounting device 20 is configured to enable hinge members 36 and 38 to move relative to one another in a direction along axes 56, 58. In the exemplary embodiment, hinge members 36 and 38 are movable in a line approximately 45 degrees relative to axis 52 to adjust both the height of hinge members 36 and 38 as well as spacing of hinge members 36 and 38. As shown by FIG. 11, movement of hinge members 36 and 38 in the directions indicated by arrows 109 enable mounting device 20 to accommodate users of different waist or hip widths.

FIGS. 11–14 illustrate hinge 38 in greater detail. As best shown by FIG. 12, support 86 of hinge 38 includes two elongate slots 122 on opposite sides of post 88. Slots 122 each extend through support 86 above an opening 124 extending through back panel 22 and through base 74 cf body 34 (shown in FIGS. 13 and 14). As best shown by FIG. 14, support 86 further includes a plurality of countersinks 128 along slot 122 while base 74 includes a countersink 130 about opening 124. Countersinks 128 are configured to receive and at least partially surround the head of bolts 92 to retain bolts 92 at a selected position along slots 122. Countersink 130 is configured to nonrotatably receive nut 90. In use, bolts 92 are captured within a selected one of countersinls 128 to retain bolts 92 in a desired position along slot 122. By unthreading bolts 92 from nut 90 to move the head of nut 90 out of countersinks 128 enables hinge 38 to be slid along slot 122 to a new position to accommodate users having different waist or hip widths. As will be appreciated, various other releasable fastening arrangements may be used to adjust the spacing between hinge members 36 and 38 as well as their relative positions with respect to axes 56 and 58.

FIGS. 15 and 16 illustrate hinge member 138, an alternative embodiment of hinge member 38. Hinge member 138 may be utilized in place of hinge members 36 and 38 shown in FIGS. 1–14. Hinge member 138 is similar to hinge member 38 except that hinge member 138 includes sliding support 186 in lieu of support 86 and additionally includes rotatable support 188.

Movable support 186 is similar to support 86 except movable support 186 does not serve as a supporting base or foundation for post mount 87, but instead serves as a supporting base or foundation for rotatable support 188. For ease of discussion, those elements of movable support 186 which correspond to elements of support 86 are numbered similarly. As best shown by FIG. 16, rotatable support 188 is rotatably coupled to movable support 186 by rivet 146. Rotatable support 188 includes two arcuate slots 144 extending above openings 148 extending through movable support 186. Movable support 186 additionally includes countersinks 150. Bolts 154 extend through slots 144 and through openings 148 to threadably engage nuts 155 nonrotatably captured within countersinks 150 within movable support 186.

As a result, rotatable support 188 rotates about axis 147 of rivet 146 and adjusts the orientation of axis 58 relative to axis 52 (shown in FIG. 1). Once rotating member 142 has been rotated about axes 147 to orient post 88 and axis 58 in a desired orientation with respect to axes 52, rotating 142 is secured in place by tightening bolts 154. Likewise, to adjust the angle at which arm 42 pivots relative to axis 52, one must merely loosen bolts 154 and rotate rotatable support 188 about axis 147. Adjusting the angle at which arm 42 pivots relative to axis 52 varies the amount of the load carried by load support 14 which is converted to create an inward clamping force by arm 42. Likewise, adjusting the angle at which arm 40 pivots relative to axis 52 adjusts the amount of load converted to inward clamping force by arm 40.

Although the present invention has been described with reference to preferred embodiments, workers skilled in the art will recognize that changes may be made in form and detail without departing from the spirit and scope of the invention. The present invention described with reference to the preferred embodiments and sets forth in the following claims is manifestly intended to be as broad as possible. For example, unless specifically otherwise noted, the claims reciting a single particular element also encompass a plurality of such particular elements.

What is claimed is:

1. A load support mounting device for use with a load support, the mounting device comprising:

a body adapted to be coupled to the load support;

first and second user engaging surfaces; and first and second arms coupled to the body at first and second spaced locations along a first axis;

wherein the first arm has a first end pivotally coupled to the body at the first location about a second axis oblique to the first axis, and a second end coupled to the first user engaging surface; and wherein the second arm has a first end pivotally coupled to the body at the second location about a third axis oblique to the first axis, and a second end coupled to the second user engaging surface, whereby the body and the first and second user engaging surfaces pivot relative to each other about a fourth axis non-parallel to the first axis, wherein the second and third axes intersect below the first axis when the mounting device is worn by the user, whereby the second ends are urged towards one another in response to loads exerted on the load support in a downward direction wherein the first axis is located rearwardly of the user when the mounting device is worn by the user.

2. The mounting device of claim 1 wherein the second and third axes extend 45 degrees relative to the first axis.

3. The mounting device of claim 1 wherein the second and third axes extend at adjustable oblique angles to the first axis.

4. The mounting device of claim 1 including first and second hinge members pivotally connecting the first ends of the first and second arms to the body about the second and third axes, respectively, wherein the first and second hinge members are rotatably coupled to the body to rotate about fourth and fifth axes, respectively, whereby rotation of the first and second hinge members about the fourth and fifth axes adjusts oblique angles at which the second and third axes extend relative to the first axis.

5. The mounting device of claim 4 wherein the first and second hinge members include first and second movable support members moveably coupled to the body, wherein the movable support members are movable in directions toward and away from each other to adjust spacing of the first and second locations at which the first and second arms are coupled to the body.

6. The mounting device of claim 5 wherein the moveable support members move along fifth and sixth axes, respectively, extending oblique to the first axis.

7. The mounting device of claim 1 wherein the first ends of the first and second arms are movably coupled to the body for movement toward and away from each other to adjust spacing of the first and second locations, respectively.

8. The mounting device of claim 1 including first and second hinge members pivotally coupling the first ends of the first and second arms to the body about the second and third axes, respectively, wherein the first and second hinge members are movably coupled to the body in directions toward and away from each other.

9. The mounting device of claim 8 wherein the first and second hinge members are movable along fifth and sixth axes, respectively, extending oblique to the first axis.

10. The mounting device of claim 9 wherein the fifth and sixth axes each extend about 45 degrees relative to the first axis.

11. The mounting device of claim 1 wherein the body includes a base configured to mount to the load support.

12. The mounting device of claim 11 including first and second stays coupled to the base proximate the first and second locations, respectively, wherein the stays longitudinally extend from the base non-parallel to the first axis, wherein the base and the first and second stays provide a frame adapted to support the load support.

13. The mounting device of claim 12 including first and second hinge members pivotally coupling the first ends of the first and second arms to the body at the first and second locations.

14. The mounting device of claim 1 including fir3t and second hinge members pivotably coupling the first ends of the first and second arms to the body at the first and second locations, wherein the body and the first and second hinge members are configured to at least partially capture the load support therebetween.

15. The load support of claim 1 wherein the first and second user engaging surfaces are connected to one another.

16. The mounting device of claim 15 including a waist belt providing the first and second user engaging surfaces and configured to encircle a user's waist.

17. The mounting device of claim 1 wherein the first and second user engaging surfaces substantially face one another.

18. The mounting device of claim 1 wherein the second ends of the first and second arms are pivotably coupled to the first and second user engaging surfaces, respectively.

19. The mounting device of claim 18 wherein one of the second end and the first user engaging surface includes a socket and the other of the second end and the first user engaging surface includes a ball received within the socket.

20. The mounting device of claim 1 wherein the first and second arms are curved and include first and second concave sides, respectively, facing one another.

21. The mounting device of claim 1 wherein the body mounts to the load support on a first side of the user's mid-coronal plane, wherein the first and second user engaging surfaces are configured to engage the user on a second opposite side of the user's mid-coronal plane and wherein the first and second arms each rigidly extend from the first side of the user's mid-coronal plane to the second opDosite side of the user's mid-coronal plane adiacent to and above the user's iliac crests.

22. The mounting device of claim 1 wherein the first and second user engaging surfaces are configured to engage the user on opposite sides of the user's mid-sagital plane.

23. The mounting device of claim 1 wherein the first and second user engaging surfaces are configured to engage the user at the user's hips above the user's iliac crest.

24. A load support system for supporting a load on a user's back, the load support system comprising:

a load support including a back panel configured to extend substantially parallel to the user's mid-coronal plane and across opposite sides of the user's mid-sagital plane when worn by the user;

first and second user engaging surfaces configured to engage the user on opposite sides of the user's mid-sagital plane; and first and second arms coupled to the back panel along a first axis and on opposite sides of the user's mid-sagital plane;

wherein the first arm has a first end pivotably coupled to the back panel about a second axis oblique to the user's mid-transverse plane and a second end coupled to the first user engaging surface; and wherein the second arm has a first end pivotably coupled to the back panel about a third axis oblique to the user's mid-transverse plane and a second end coupled to the second user gripping surface, wherein the second and third axes intersect below the first axis when the mounting device is worn by the user, whereby the second ends are urged towards one another in response to loads exerted on the load support in a downward direction whherein the first axis is located rearwardly of the user when the load support system is wirn by the user.

25. The load support system of claim 24 including a substantially rigid body coupled to the back panel of the load support, wherein the first ends of the first and second arms are pivotably coupled to the body.

26. The load support system of claim 24 wherein the second ends of the first and second arms are pivotably coupled to the first and second user engaging surfaces, respectively.

27. The load support system of claims 26 wherein one of the second end and the first user engaging surface include a socket and the other of the second end and the first user engaging surface includes a ball received within the socket.

28. The load support system of claim 24 wherein the first and second user engaging surfaces are connected to one another.

29. The load support system of claim 28 including a waist belt providing the first and second user engaging surfaces and configured to encircle the user's waist.

30. The load support system of claim 24 including first and second hinge members pivotably coupling the first ends of the first and second arms to the back panel about the second and third axes, respectively, wherein the first and second hinge members are rotatably coupled to the back panel to rotate about fourth and fifth axes, respectively, whereby rotation of the first and second hinge members about the fourth and fifth axes adjusts oblique angles at which the second and third axes extend relative to the first axis.

31. The load support system of claim 24 wherein the first ends of the first and second arms, respectively, are further movable in directions toward and away from each other, whereby the distance separating the first ends of the first and second arms may be adjusted to accommodate different users.

32. The load support system of claim 24 wherein the second and third axes extend about 45 degrees relative to the first axis.

33. The load support system of claim 24 including a plurality of panels extending from the back panel to form an interior.

34. The load support system of claim 24 including a shoulder support coupled to the back panel and configured to extend from the user's posterior side to the user's anterior side over the user's shoulders.

35. A load support system for supporting a load on a user's back, the load support system comprising:

a load support including a back panel configured to extend substantially parallel to the user's mid-coronal plane and across opposite sides of the user's mid-sagital plane when worn by the user;

a waist belt configured to encircle the user's waist; and first and second arms coupled to the back panel along a first axis and on opposite sides of the user's mid-sagital plane;

wherein the first arm has a first end pivotably coupled to the back panel about a second axis oblique to the user's mid-transverse plane and a second end pivotably coupled to the waist belt; and wherein the second arm has a first end pivotably coupled to the back panel about a third axis oblique to the user's mid-transverse plane and a second end pivotably coupled to the waist belt, wherein the second and third axes extend at adjustable oblique angles to the first axis by an adjustment device associated with each said first end.

* * * * *

UNITED STATES PATENT AND TRADEMARK OFFICE

CERTIFICATE OF CORRECTION

PATENT NO. : 6,199,732 B1
DATED : March 13, 2001
INVENTOR(S) : Thomas R. Swetish It is certified that error appears in the above-identified patent and that said Letters Patent is hereby corrected as shown below:

Claim 14,
Line 7, "fir3t" should read -- first --.

Claim 21,
Line 34, "opDosite" should read -- opposite --.

Claim 24,
Line 65, "whherein" should read -- wherein --.
Line 66, "wirn" should read -- worn --.

Signed and Sealed this

Twenty-eighth Day of August, 2001

*Attest:*

Nicholas P. Godici

*Attesting Officer*

NICHOLAS P. GODICI
*Acting Director of the United States Patent and Trademark Office*